US006581216B1

(12) United States Patent
Halsell

(10) Patent No.: US 6,581,216 B1
(45) Date of Patent: Jun. 24, 2003

(54) COMMODE SHUTOFF DEVICE

(76) Inventor: Richard Halsell, 13904 Brays Forest, San Antonio, TX (US) 78217

( * ) Notice: Subject to any disclaimer, the term of this patent is extended or adjusted under 35 U.S.C. 154(b) by 0 days.

(21) Appl. No.: 10/196,262

(22) Filed: Jul. 17, 2002

(51) Int. Cl.[7] ..... E03D 1/00; E03D 11/02; E03D 11/18; E03D 1/14; E03D 3/12

(52) U.S. Cl. ..... 4/415; 4/324; 4/325; 4/353; 4/427

(58) Field of Search ..... 4/427, 415, 353, 4/324, 325

(56) References Cited

U.S. PATENT DOCUMENTS

| | | | | | |
|---|---|---|---|---|---|
| 2,183,677 | A | | 9/1939 | Heath | |
| 2,583,468 | A | * | 1/1952 | Castellano | 4/67 |
| 4,980,932 | A | * | 1/1991 | Stemples | 4/415 |
| 5,062,166 | A | | 11/1991 | Krenecki | |
| 5,134,729 | A | * | 8/1992 | Shaw | 4/415 |
| 5,452,482 | A | | 9/1995 | Nichols-Roy et al. | |
| 5,584,080 | A | | 12/1996 | Nichols-Roy et al. | |
| 5,594,959 | A | | 1/1997 | Nichols-Roy et al. | |
| 5,715,860 | A | * | 2/1998 | Horad | 137/441 |
| 5,855,025 | A | | 1/1999 | Williams | |
| 6,385,788 | B1 | * | 5/2002 | Wasielewski | 4/415 |

* cited by examiner

*Primary Examiner*—Gregory Huson
*Assistant Examiner*—Anuradha Ramana
(74) *Attorney, Agent, or Firm*—Gunn, Lee & Hanor, P.C.; Michelle Evans

(57) ABSTRACT

A commode shutoff device having a diverter housing, diverter valve within diverter housing, diverter arm, a means for actuating the diverter arm, support bracket, and an alternate water line is disclosed. Water is redirected from the overflow water line to the alternate water line by actuating the diverter arm through manually pulling up on the flush handle. Once the water is redirected, it can no longer flow into the bowl, thus preventing an overflow.

12 Claims, 2 Drawing Sheets

COMMODE SHUTOFF DEVICE

BACKGROUND OF THE INVENTION

1. Field of the Invention

Applicant's invention relates to a commode shutoff device to prevent commode overflows.

2. Background Information

In order to understand the importance of the present invention, it is necessary to review the basics of how a commode works. In general a commode consists of a bowl and a tank. The critical mechanism molded into the bowl is the bowl siphon. The water level within the bowl is kept at the same level as within the siphon tube. When a small amount of water is put into the bowl, it will spill over the edge of the siphon tube and drain away. When a large amount of water is poured into the bowl all at once, it causes the bowl to flush. As soon as the bowl is emptied, air enters the siphon tube and stops the siphoning process.

The tank allows a large amount of water to be held until needed to activate the siphon. Activation of the siphon with the flush is initiated with the flush handle. The flush handle is typically attached to a rod which has at its end a chain. This chain is typically attached at its other end to a flush valve which covers a large drain hole. When the user pushes down on the flush handle, the opposite end of the rod is pulled up pulling the chain and the flush valve with it. Once the flush valve is removed, the water from the tank flows through the drain hole into the bowl. The water is then forced through the siphon.

Once the tank is completely drained the flush valve reseats itself into the drain hole. This allows the tank to be refilled. When the water drained out the fill float dropped with the water level. When this fill float falls it activates the fill valve which turns the water on for refilling the tank and bowl. When refilling the tank, some of the water goes down the fill tube. The rest of the water goes through the fill tube and down the overflow tube into the bowl. The fill float rises in the tank as the water level rises until eventually the fill valve shuts off.

In theory the overflow tube is in place to prevent overflow of water from the tank onto the floor if something goes wrong with the fill valve or float. Instead the water is directed into the bowl. This diversion can cause problems as well since the bowl itself can overflow the water onto the floor. The present invention is designed to prevent this overflow of water from occurring by providing for a device that shuts off the commode.

SUMMARY OF THE INVENTION

It is an object of the present invention to provide a novel commode shutoff device.

Yet another object of the present invention is to provide a novel commode shutoff device that has a diverter housing, a diverter valve situated within the diverter housing, a diverter arm, a means for actuating the diverter arm, a support bracket, and an alternate water line.

Still another object of the present invention is to provide a novel commode shutoff device that redirects water from the overflow water line to the alternate water line by actuation of a diverter arm through manually pulling up on the flush handle of the tank.

Another object of the present invention is to provide a novel commode shutoff device that redirects water so that it no longer flows into the bowl, thus preventing overflow.

It is another object of the present invention to provide a novel method for shutting off a commode.

An additional object of the present invention is to provide a novel method for shutting off a commode by pulling up on the flush handle.

Still another object of the present invention is to provide a novel method for shutting off a commode wherein when the flush handle is pulled upward, trip lever within tank is forced down onto the diverter arm.

Yet another object of the present invention is to provide a novel method for shutting off a commode wherein when the diverter arm is forced down, the diverter valve is rotated.

Another object of the present invention is to provide a novel method for shutting off a commode wherein when the diverter valve is rotated, water is redirected from the overflow water line within the tank to an alternate water line of the invention.

Still another object of the present invention is to provide a novel method for shutting off a commode wherein when the water is redirected to alternate water line, the water is forced onto flush valve.

It is another object of the present invention to provide a novel method for shutting off a commode wherein the flush valve is forced closed by the redirected water.

In satisfaction of these and related objectives, Applicant's present invention provides a way of manually shutting off a commode to prevent overflow. This manual shut off allows a user to pull upward on the flush handle to induce shut off. The action of pulling upward on the flush handle causes the internal trip lever to be forced down onto the diverter arm of the present invention. When the diverter arm is actuated in this manner, it rotates a diverter valve located within a diverter housing. This rotation redirects water from the overflow water line, which would occur in normal operation, to an alternate water line. This diversion to the alternate water line not only prevents water from flowing into the bowl through the overflow water line, but also forces water is onto the flush valve closing it.

DETAILED DESCRIPTION OF THE PREFERRED EMBODIMENT

Figure 1:
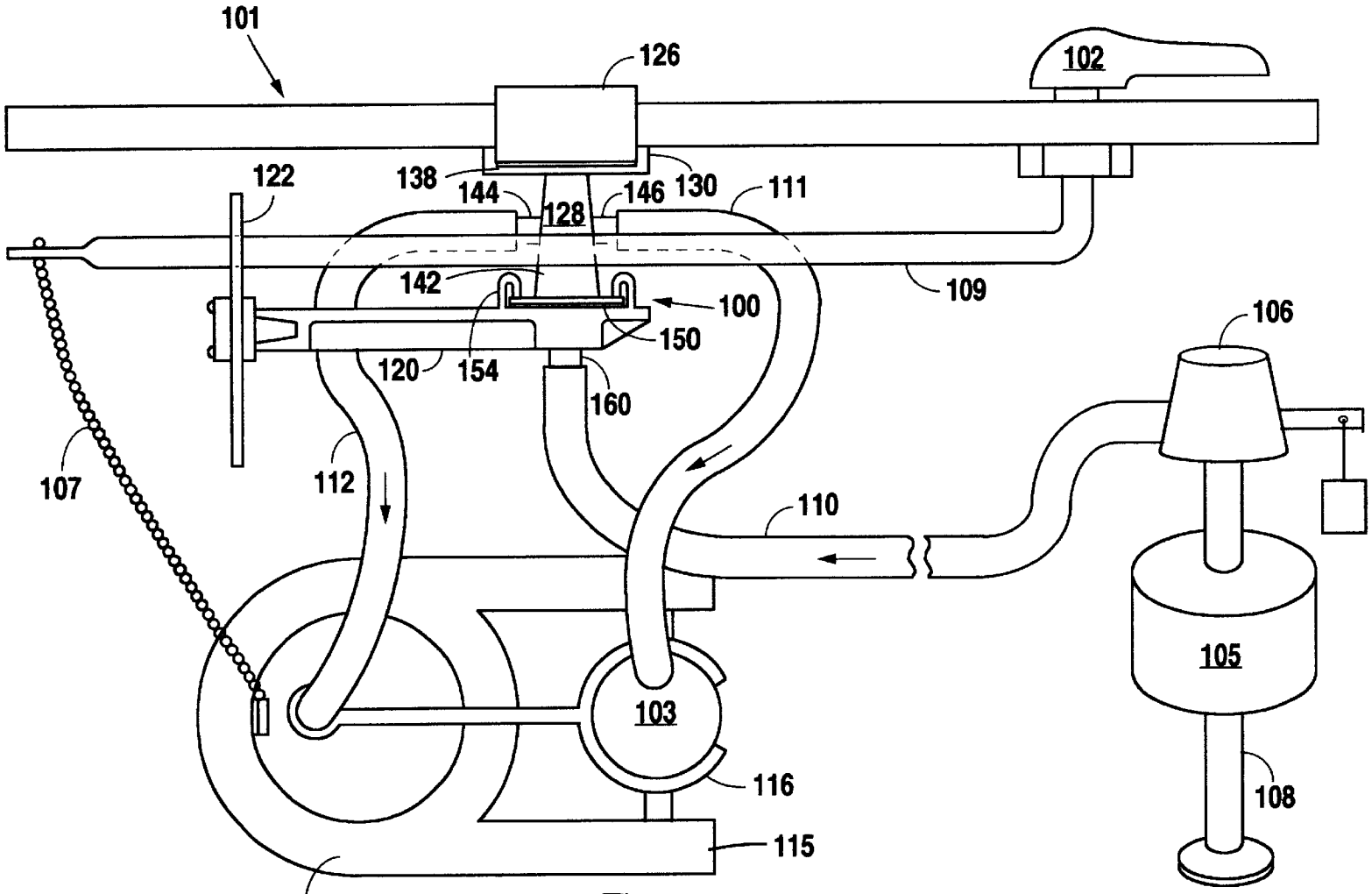
FIG. 1 is a perspective view of the preferred embodiment of the present invention as it would be placed in a tank of a standard commode.

Referring to FIG. 1, a perspective view of the preferred embodiment of the present invention 100 is shown as it would be placed in a tank 101 of a standard commode. As mentioned earlier, the tank 101 allows a large amount of water to be is held until needed to activate the siphon (not shown). Activation of the siphon with the flush is initiated with the flush handle 102. The flush handle 102 is typically attached to a trip lever 109 which has at its end a chain 107. This chain 107 is typically attached at its other end to a flush valve 104 which covers a large drain hole (not shown). When the user pushes down on the flush handle 102, the opposite end of the trip lever 109 is pulled up pulling the chain 107 and the flush valve 104 with it. Once the flush valve 104 is removed, the water from the tank 101 flows through the drain hole into the bowl (not shown). The flush valve 104 is typically anchored to the overflow tube 103 by way of flush valve arms 115. The water is then forced through the siphon (not shown).

Once the tank 101 is completely drained the flush valve 104 reseats itself by way of the flush valve seat (not shown) into the drain hole. This allows the tank 101 to be refilled. When the water is drained out the fill float 105 drops with the water level. When this fill float 105 falls it activates the fill valve 106 which turns the water on for refilling the tank 101 and bowl (not shown). When refilling the tank 101, some of the water goes through the fill tube 108 and water line 110 and down the overflow tube 103 into the bowl (not shown). The fill float 105 rises in the tank 101 as the water level rises until eventually the fill valve 106 shuts off.

The overflow tube 103 is in place to prevent overflow of water from the tank 101 onto the floor if something goes wrong with the fill valve 106 or fill float 105. Instead the water is directed into the bowl (not shown). This diversion can cause problems as well since the bowl itself can overflow the water onto the floor. The present invention 100 shuts off the commode in such a situation.

The present invention 100 effectively reroutes the water flow from water line 110 that originated at fill valve 106. This water flow would have flowed through overflow water line 111 into overflow tube 103 to refill the bowl (not shown). However, since water flowing into the bowl is no longer wanted, the water is directed into alternate water line 112. Alternate water line 112 is preferably attached to the side of overflow tube 103 by way of a bracket 116 with the end of alternate water line directed at the top of flush valve 104. When water is diverted in this manner, flush valve 104 is forced closed and water flow to the bowl is stopped, thus preventing overflow.

Figure 2A:
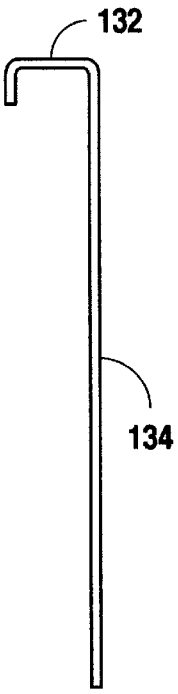
FIG. 2*a* is a side view of adjustable housing bracket.
Figure 2B:
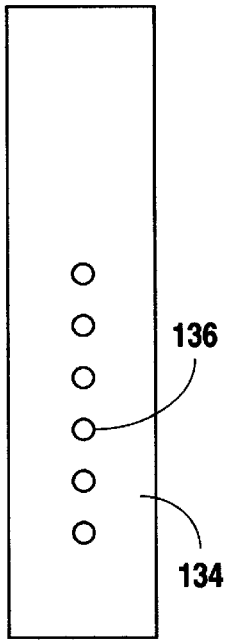
FIG. 2*b* is a front view of adjustable housing bracket.

The redirection of water flow occurs by way of the present invention 100. The present invention 100 has an adjustable housing bracket 126 which is used to anchor the invention 100 to the side of tank 101. Adjustable housing bracket 126 is generally flat and has a formed lip 132 (See FIG. 2*a*) at one end for ease of attachment to tank 101. Along the front 134 (See FIG. 2*b*) of the adjustable housing bracket 126 are openings 136 (See FIG. 2*b*) which can be used in adjusting the bracket 126 within tank 101.

Figure 3A:
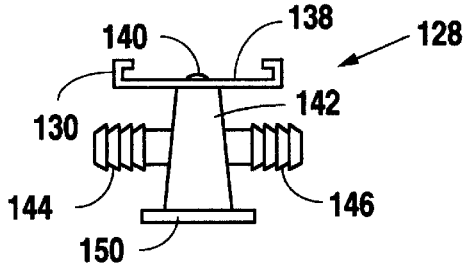
FIG. 3*a* is a top view of diverter housing.
Figure 3B:
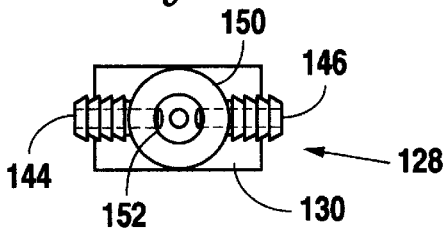
FIG. 3*b* is a back view of diverter housing.
Figure 3C:
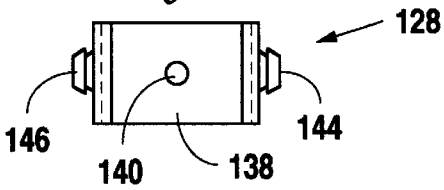
FIG. 3*c* is a front view of diverter housing.
Figure 4A:
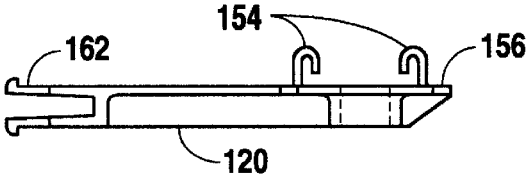
FIG. 4*a* is a top view of diverter arm.

A diverter housing 128 of the present invention 100 slides onto adjustable housing bracket 126 by way of square ends 130. Square ends 130 connect to each other by way of back 138 having a central hole 140(See FIG. 3*a*). Behind back 138 is housing member 142 with a left and right water diverter 144 and 146 respectively. Alternate water line 112 is situated over left water diverter 144 and overflow water line 111 is situated over right water diverter 146. Housing member 142 terminates in round end 150. A back view of the diverter housing 128 is shown in FIG. 3*b*. Holes 152 pass through round end 150 to allow movement of water through either the left 144 or right water diverter 146. The front view of diverter housing 128 is shown in FIG. 3*c*. Again the left 144 and right water diverter 146 are illustrated. Hole 140 is shown located on back 138.

Figure 6A:
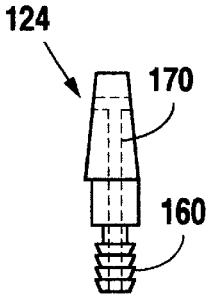
FIG. 6*a* is a top view of diverter valve.
Figure 6B:
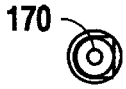
FIG. 6*b* is a bottom view of diverter valve.
Figure 6C:
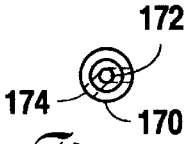
FIG. 6*c* is a top view of diverter valve.

A diverter valve 124 (See FIG. 6*a*) is situated within diverter housing 128 to divert water from overflow water line 111 to alternate water line 112 upon activation. As shown in FIGS. 6*a* and *b*, diverter valve 124 has a central canal 170. Diverter valve 124 also has a primary port 172 and a secondary port 174 that branch from the central canal 170 as can be seen in FIG. 6*c*. During normal usage primary port 172 and secondary port 174 exist in the position as indicated in FIG. 6*c* whereby water will flow into central canal 170 and be directed through right water diverterl46 to overflow water line 111. Upon actuation of the present invention 100, diverter valve 124 will be rotated to a position that still allows water to flow into central canal 170, but diverts water instead through left water diverter 144 into alternate water line 112.

Figure 5:
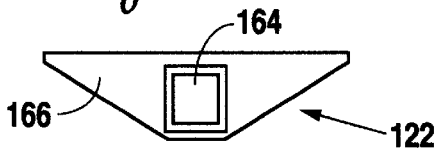
FIG. 5 is a side view of support bracket.
Figure 4B:
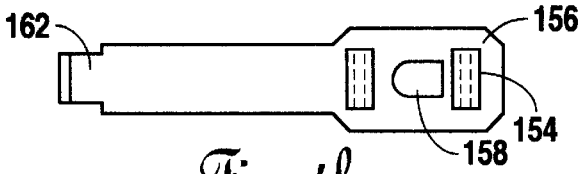
FIG. 4*b* is a front view of diverter arm.
Figure 4C:
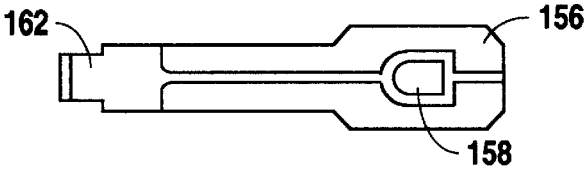
FIG. 4*c* is a back view of diverter arm.

Round end 150 slides into envelope sections 154 of diverter arm 120. Envelope sections 154 are affixed to ledge 156 having a hole 158 (See FIG. 4*b*) which passes through ledge 156. Water line 110 connects over fitting 160 to allow water from fill valve 106 to pass through hole 158 and into diverter valve 125. At the end 162 of diverter arm 120 is support bracket 122. End 162 fits into opening 164 within triangular member 166 of support bracket 122 as shown in FIG. 5.

To operate the present invention 100 to shut off the commode to prevent overflow, the user pushes the flush handle 102 into its "UP" position. This forces trip lever 109 down onto support bracket 122 which in turn forces diverter arm 120 down. When diverter arm 120 is forced down it rotates diverter valve 124 (See FIGS. 6*a-c*) and redirects water from overflow water line 111 to alternate water line 112. This forces water onto flush valve 104 to close it, and water flow to the bowl is stopped preventing overflow.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A device for placement into a tank of a commode having an overflow pipe, flush handle, trip lever, flush valve, and a fill valve connected therein, said device acting as a shutoff device for said commode and comprising:

a housing;

an arm adjacent said housing;

a valve situated within said housing;

an overflow water line coupled to said housing; and an alternate water line coupled to said housing, whereby when said flush handle is lifted, said arm is actuated rotating said valve and diverting water from said overflow water line to said alternate water line.

2. The device for placement into a tank of a commode having an overflow pipe, flush handle, trip lever, flush valve, and a fill valve connected therein, said device acting as a shutoff device for said commode of claim 1 further comprising a housing bracket adjacent said housing.

3. The device for placement into a tank of a commode having an overflow pipe, flush handle, trip lever, flush valve, and a fill valve connected therein, said device acting as a shutoff device for said commode of claim 2 wherein said housing bracket is adjustable.

4. The device for placement into a tank of a commode having an overflow pipe, flush handle, trip lever, flush valve, and a fill valve connected therein, said device acting as a shutoff device for said commode of claim 2 further comprising a support bracket adjacent said arm.

5. The device for placement into a tank of a commode having an overflow pipe, flush handle, trip lever, flush valve, and a fill valve connected therein, said device acting as a shutoff device for said commode of claim 2 further comprising a water line adjacent said housing.

6. A method for shutting off a commode having an overflow pipe, flush handle, trip lever, flush valve, and a fill valve connected therein comprising the steps of:

pulling said flush handle upward; and redirecting water from said overflow water line to an alternate water line directed at said flush valve.

7. A method for shutting off a commode having an overflow pipe, flush handle, trip lever, flush valve, and a fill valve connected therein of claim 6 further comprising the step of first forcing said trip lever downward.

8. A method for shutting off a commode having an overflow pipe, flush handle, trip lever, flush valve, and a fill valve connected therein of claims 7 further comprising the step of second forcing an arm downward.

9. A method for shutting off a commode having an overflow pipe, flush handle, trip lever, flush valve, and a fill valve connected therein of claim 8 further comprising the step of rotating a valve within a housing.

10. The method for shutting off a commode having an overflow pipe, flush valve, and a fill valve connected therein of claim 9 further comprising the step of next forcing a support bracket down.

11. The method for shutting off a commode having an overflow pipe, flush valve, and a fill valve connected therein of claim 10 further comprising the step of mounting said housing to the tank of said commode with a bracket.

12. The method for shutting off a commode having an overflow pipe, flush valve, and a fill valve connected therein of claim 11 further comprising the step of adjusting said bracket to fit said commode.

* * * * *